US012781758B2

(12) United States Patent
Yuan et al.

(10) Patent No.: US 12,781,758 B2
(45) Date of Patent: Nov. 3, 2026

(54) BLADE AND AXIAL IMPELLER USING SAME

(71) Applicants: YORK GUANGZHOU AIR CONDITIONING AND REFRIGERATION CO., LTD., Guangdong (CN); JOHNSON CONTROLS TYCO IP HOLDINGS LLP

(72) Inventors: Bin Yuan, Qingyuan (CN); Chenggang Wu, Qingyuan (CN); Xiaokui Ma, Qingyuan (CN); Li Wang, Qingyuan (CN); Jian Zhu, Qingyuan (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/878,769

(22) PCT Filed: Jun. 12, 2023

(86) PCT No.: PCT/CN2023/099661
§ 371 (c)(1),
(2) Date: Dec. 24, 2024

(87) PCT Pub. No.: WO2024/001739
PCT Pub. Date: Jan. 4, 2024

(65) Prior Publication Data

US 2025/0382971 A1 Dec. 18, 2025

(30) Foreign Application Priority Data

Jun. 27, 2022 (CN) ..... 202210741756.6

(51) Int. Cl.
*F04D 29/38* (2006.01)
*F04D 29/66* (2006.01)

(52) U.S. Cl.
CPC ..... *F04D 29/384* (2013.01); *F04D 29/66* (2013.01)

(58) Field of Classification Search
CPC ..... F04D 29/181; F04D 29/32; F04D 29/321; F04D 29/324; F04D 29/38; F04D 29/384; F04D 29/386; F04D 29/66; F04D 29/661
(Continued)

(56) References Cited

U.S. PATENT DOCUMENTS 10,052,931 B2 * 8/2018 Nakashima ..... F04D 25/166

FOREIGN PATENT DOCUMENTS

CN 202326414 U * 7/2012
CN 104389810 A * 3/2015 ..... F04D 29/181
(Continued)

OTHER PUBLICATIONS

PCT International Search Report for PCT Application No. PCT/CN2023/099661, mailed Aug. 12, 2023, 4 pgs.

*Primary Examiner* — Nathaniel E Wiehe
*Assistant Examiner* — Justin A Pruitt
(74) *Attorney, Agent, or Firm* — Fletcher Yoder, P.C.

(57) ABSTRACT

The present application discloses a blade and an axial-flow impeller using the same. The present application provides a blade, comprising a blade tip, a blade root, a leading edge and a trailing edge, wherein the leading edge and the trailing edge extend from the blade tip to the blade root, respectively. The blade is capable of rotating about a rotation axis X which is perpendicular to a normal plane. In a projection of the blade on the normal plane, a circumferential included angle between the leading edge and the trailing edge forms a wrap angle, and the wrap angle decreases gradually from
(Continued)

the blade root to a middle blade height of the blade and increases gradually from the middle blade height to the blade tip. Wherein, the middle blade height is an arc line formed by center points of the blade tip and the blade root along a radial direction. The blade of the present application allows for significantly reduced turbulent vortices and reduced intensity in the vicinity of the junction of the leading edge and the blade tip of the blade and in the vicinity of the junction of the trailing edge and the blade tip of the blade during the operation of the axial-flow impeller, leading to evenly lightened load of airflow on the blade, more uniform distributions of velocity and pressure, reduced velocity and pressure pulsations, and reduced noise.

9 Claims, 5 Drawing Sheets

(58) Field of Classification Search
USPC ..... 416/223 R
See application file for complete search history.

(56) References Cited

FOREIGN PATENT DOCUMENTS

| | | | | | |
|---|---|---|---|---|---|
| CN | 104895838 | A | | 9/2015 | |
| CN | 108506247 | A | | 9/2018 | |
| CN | 208380968 | U | | 1/2019 | |
| CN | 110500320 | A | * | 11/2019 | ..... F04D 29/667 |
| CN | 110513329 | A | * | 11/2019 | ..... F04D 29/388 |
| CN | 111577655 | A | | 8/2020 | |
| CN | 113757168 | A | | 12/2021 | |
| CN | 115111194 | A | | 9/2022 | |
| EP | 2642130 | A1 | | 9/2013 | |
| JP | H10311296 | A | | 11/1998 | |
| JP | 2006258107 | A | | 9/2006 | |
| JP | 2013217316 | A | | 10/2013 | |

* cited by examiner

BLADE AND AXIAL IMPELLER USING SAME

CROSS-REFERENCE TO RELATED APPLICATIONS

This application is a U.S. National Stage Application of International Application No. PCT/CN2023/099661, entitled "BLADE AND AXIAL IMPELLER USING SAME," filed Jun. 12, 2023, which claims priority to and the benefit of Chinese Patent Application No. 202210741756.6, filed Jun. 27, 2022, each of which is hereby incorporated by reference in its entirety for all purposes.

TECHNICAL FIELD

The present application relates to the field of rotating machinery such as fans, pumps and compressors, and more particularly to a blade and an axial-flow impeller using the same.

BACKGROUND ART

A leading edge and a trailing edge of a traditional blade are usually monotonous smooth curves. Since serious flow separation on the surface of the blade induces a vortex, a loud noise is produced.

SUMMARY OF THE INVENTION

Exemplary embodiments of the present application may address at least some of the above-mentioned problems. According to a first aspect of the present application, the present application provides a blade, comprising a blade tip, a blade root, a leading edge and a trailing edge, wherein the leading edge and the trailing edge extend from the blade tip to the blade root, respectively, and the blade is capable of rotating about a rotation axis X which is perpendicular to a normal plane. In a projection of the blade on the normal plane, a circumferential included angle between the leading edge and the trailing edge forms a wrap angle $\phi$, and the wrap angle $\phi$ decreases gradually from the blade root to a middle blade height of the blade and increases gradually from the middle blade height to the blade tip, wherein the middle blade height is an arc line formed by center points of the blade tip and the blade root along a radial direction.

According to the blade of the first aspect described above, the rotation axis X and the normal plane intersect perpendicularly at a foot of a perpendicular O. A line connecting any point on the leading edge and the foot of the perpendicular O is designated as a first connecting line, and a line connecting a projection point A of an intersection point of the blade root and the leading edge on the normal plane in a direction of the rotation axis X and the foot of the perpendicular O is a second connecting line. An included angle between the first connecting line and the second connecting line is called a starting angle $\Theta$, wherein the starting angle $\Theta$ increases gradually in a direction from the blade root to the blade tip.

According to the blade of the first aspect described above, a value range of the starting angle $\Theta$ is: $\Theta \in [0°, 90°]$.

The blade according to the first aspect described above comprises an upper surface and a lower surface. The upper surface and the lower surface are curved downwards in a radial cross section of the blade from the middle blade height to the blade tip.

According to the blade of the first aspect described above, a vertical line from a highest point on the trailing edge to the rotation axis X is designated as a first vertical line, the first vertical line having a vertical point on the rotation axis X, and a line connecting an intersection point of the trailing edge and the blade tip and the vertical point is designated as a third connecting line. In a projection direction along the rotation axis X, an included angle between the first vertical line and the third connecting line is a winglet angle $\alpha$, and a value range of the winglet angle $\alpha$ is: $\alpha \in [1°, 15°]$.

According to the blade of the first aspect described above, in the projection direction along the rotation axis X, a line connecting the intersection point of the blade root and the leading edge and an intersection point of the blade tip and the leading edge is designated as a fourth connecting line. An included angle between the fourth connecting line and the normal plane is designated as a sweep forward angle $\beta$, and a value range of the sweep forward angle $\beta$ is: $\beta \in [5°, 30°]$; and the leading edge is located in a region formed by a rotation of the sweep forward angle $\beta$ about the rotation axis X.

According to a second aspect of the present application, the present application provides an axial-flow impeller comprising a hub and at least two blades described above. The hub has a rotation axis X and is capable of rotating about the rotation axis X. The at least two blades are arranged on an outer circumferential surface of the hub.

According to the axial-flow impeller of the second aspect described above, the wrap angle $\phi$ is related to a number of the blades.

According to the axial-flow impeller of the second aspect described above, when the axial-flow impeller has three blades, the value range of the wrap angle $\phi$ is: $\phi \in [80°, 100°]$; when the axial-flow impeller has four blades, the value range of the wrap angle $\phi$ is: $\phi \in [60°, 85°]$; and when the axial-flow impeller has five blades, the value range of the wrap angle $\phi$ is: $\phi \in [40°, 70°]$.

The blade of the present application allows for significantly reduced turbulent vortices in the vicinity of the junction of the leading edge and the blade tip of the blade and in the vicinity of the junction of the trailing edge and the blade tip of the blade during the operation of the axial-flow impeller, leading to evenly lightened load of airflow on the blade, more uniform velocity, mitigated velocity pulsations, and reduced noise.

BRIEF DESCRIPTION OF THE DRAWINGS

The features and advantages of the present application can be better understood when the following detailed description is read with reference to the accompanying drawings. Like reference numerals denote like parts throughout the accompanying drawings, in which.

DETAILED DESCRIPTION OF EMBODIMENTS

Figure 1:
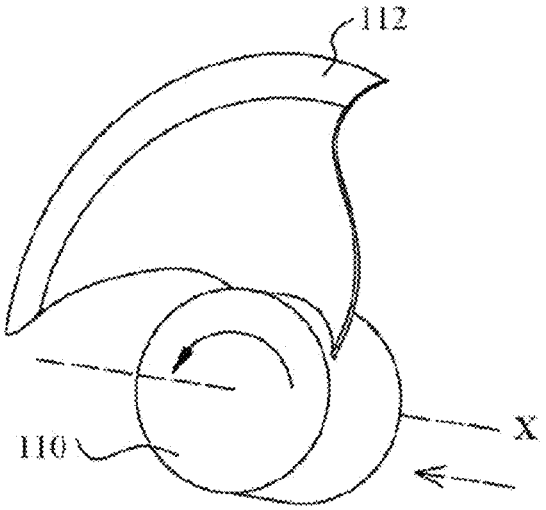
FIG. 1 is a three-dimensional view of an axial-flow impeller using a blade according to the present application.

Various embodiments of the present application will be described below with reference to the accompanying drawings that constitute a part of the present description. In the following drawings, identical parts and components are denoted by identical reference numerals.

FIG. 1 is a three-dimensional view of an axial-flow impeller 100 using a blade according to the present application, in which only one blade 112 is shown. As shown in FIG. 1, the axial-flow impeller 100 comprises a hub 110 and a blade 112. The hub 110 has a rotation axis X, and a cross section of the hub 110 perpendicular to the rotation axis X is circular. The axial-flow impeller 100 may comprise at least two blades 112. The at least two blades 112 are evenly arranged on an outer circumferential surface of the hub 110 and are integrally connected to the hub 110. The hub 110 and the blade 112 are capable of rotating together about the rotation axis X. As an example, the axial-flow impeller 100 of the present application rotates about the rotation axis X in a counterclockwise direction (i.e, a direction of rotation indicated by the arrow in FIG. 1). The dotted arrow in FIG. 1 indicates a flow direction of airflow. It will be appreciated by a person skilled in the art that while the hub 110 shown in the present application is a cylinder, the hub 110, in other embodiments, may also be in other shapes.

Figure 2:
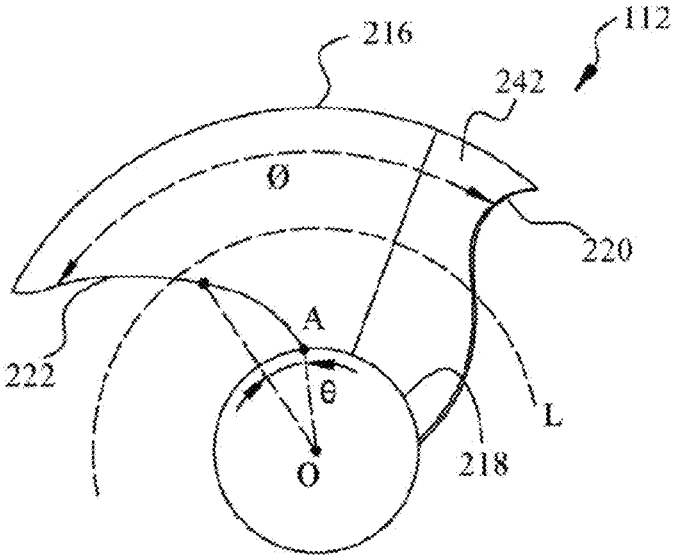
FIG. 2 is a top view of the axial-flow impeller in FIG. 1.

FIG. 2 is a top view of the axial-flow impeller 100 in FIG. 1. As shown in FIG. 2, the blade 112 comprises an upper surface 242, a lower surface 244 (see FIG. 3), a blade tip 216, a blade root 218, a leading edge 222 and a trailing edge 220. The upper surface 242 and the lower surface 244 are disposed oppositely. Wherein, the "leading edge 222" represents a front end edge in a direction of rotation of the blade. The "trailing edge 220" represents a rear end edge in the direction of rotation of the blade. The "blade root 218" represents an edge where the blade 112 and the hub 110 intersect. The "blade tip 216" represents the other edge opposite to the blade root 218. The blade tip 216, the blade root 218, the leading edge 222 and the trailing edge 220 surround the upper surface 242 and the lower surface 244. In other words, the upper surface 242 and the lower surface 244 extend from the blade tip 216 to the blade root 218, respectively, and extend from the leading edge 222 to the trailing edge 220, respectively.

As shown in FIG. 2, the blade 112 is capable of rotating about the rotation axis X which is perpendicular to a normal plane. In other words, the top view of the axial-flow impeller 100 shown in FIG. 2 is also a projection diagram of the axial-flow impeller 100 on the normal plane. In the projection on the normal plane, the blade tip 216 and the blade root 218 of the blade 112 are circular-arc-shaped. The blade 112 has varying blade heights in a radially outward direction from the blade root 218 to the blade tip 216. Specifically, a radius where the circular arc of the blade root 218 is located is referred to as "0% blade height". A radius where the circular arc of the blade tip 216 is located is referred to as "100% blade height". A connecting line of center points of the blade tip 216 and the blade root 218 of the blade 112 at each position in the radial direction is circular-arc-shaped, which is referred to as "middle blade height L", i.e., "50% blade height". A circumferential included angle between the leading edge 222 and the trailing edge 220 forms a wrap angle $\phi$. In the blade 112 shown in the present application, the wrap angle $\phi$ decreases gradually from the blade root 218 to the middle blade height L and increases gradually from the middle blade height L to the blade tip 216. When the blade 112 rotates, since the middle blade height L of the blade 112 has the smallest wrap angle, a load at the middle blade height L is greater. This allows for a decrease in a load at the blade root 218, thereby improving the strength of the blade root 218. In addition, the wrap angle $\phi$ increases gradually from the middle blade height L to the blade tip 216 so that an area of applying work at the blade tip 216 can be increased and the uniformly distributed load at the position of the blade tip 216 can be reduced. A value range of the wrap angle $\phi$ is: $\phi \in [40°, 100°]$. More specifically, the value range of the wrap angle $\phi$ is related to the number of blades 112 that the axial-flow impeller 100 includes. When the axial-flow impeller 100 includes three blades 112, the value range of the wrap angle $\phi$ is: $\phi \in [80°, 100°]$. When the axial-flow impeller 100 includes four blades 112, the value range of the wrap angle $\phi$ is: $\phi \in [60°, 85°]$. When the axial-flow impeller 100 includes three blades 112, the value range of the wrap angle $\phi$ is: $\phi \in [40°, 70°]$.

As shown in FIG. 2, in the projection on the normal plane, the rotation axis X and the normal plane intersect perpendicularly at a foot of a perpendicular O. A line connecting any 5 point on the front edge 222 and the foot of the perpendicular O is designated as a first connecting line. A line connecting a projection point A of an intersection point of the blade root 218 and the leading edge 222 on the normal plane in a direction of the rotation axis X and the foot of the perpendicular O is designated as a second connecting line. An included angle between the first connecting line and the second connecting line is called a starting angle $\Theta$. The starting angle $\Theta$ increases gradually in a direction from the blade root 218 to the blade tip 216. As an example, a value range of the starting angle $\Theta$ is: $\Theta \in [0°, 90°]$. The starting angle $\Theta$ is beneficial to reduce the noise while maintaining the aerodynamic performance.

Figure 3:
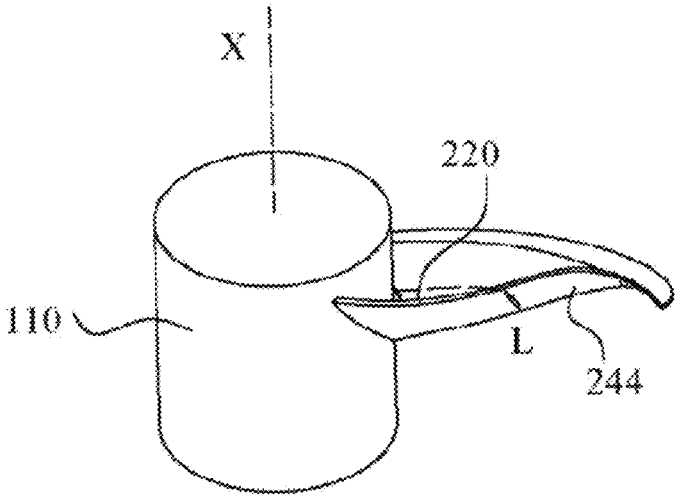
FIG. 3 is a three-dimensional view of the axial-flow impeller in FIG. 1.

FIG. 3 is a three-dimensional view of the axial-flow impeller 100 in FIG. 1 to show a structure of the blade 112 in the direction of the rotation axis X. As shown in FIG. 3, the upper surface 242 and the lower surface 244 are curved downwards in a radial cross section from the middle blade height L to the blade tip 216.

Figure 4:
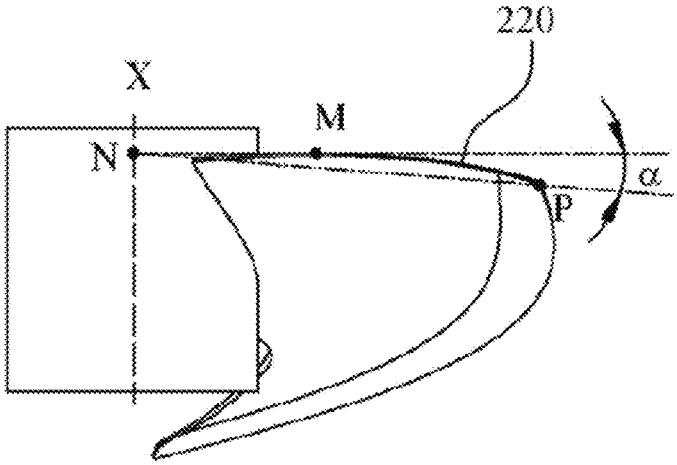
FIG. 4 is a side view of the axial-flow impeller in FIG. 1 in a first direction.

FIG. 4 is a side view of the axial-flow impeller 100 in FIG. 1 viewed in a first direction to show a specific structure of the trailing edge 220. As shown in FIG. 4, a vertical line from a highest point M of the trailing edge 220 in the direction of the rotation axis X to the rotation axis X is designated as a first vertical line, the first vertical line having a vertical point N on the rotation axis X and a line connecting an intersection point P of the trailing edge 220 and the blade tip 216 and the vertical point N is designated as a third connecting line. In a projection direction along the rotation axis X, an included angle between the first vertical line and the third connecting line is a winglet angle $\alpha$, and a value range of the winglet angle $\alpha$ is: $\alpha \in [1°, 15°]$. Thus, a trailing end of the blade tip 216 is tilted toward the lower surface 244 in an axial direction so that a relative velocity at the blade tip 216 can be reduced. More specifically, an absolute velocity of a fluid is composed of vectors of the relative velocity and a tangential velocity. Since the relative velocity at the blade tip 216 is reduced, the absolute velocity of the fluid is reduced, thereby controlling a thickness of a turbulent boundary layer on the wall surface of the upper surface 242, slowing down the separation of the boundary layer, and achieving the delaying and suppression of vortex shedding.

As an example, the trailing edge 220 is a smooth quadratic curve in a coordinate system with the first vertical line as the x-axis and the rotation axis X as the y-axis. Specifically, there is a tangent line at each point on the trailing edge 220, and the tangent line rotates continuously as a tangent point moves. Furthermore, a curve equation of the trailing edge 220 is $y=ax^2+bx+c$, where $a \neq 0$.

Figure 5:
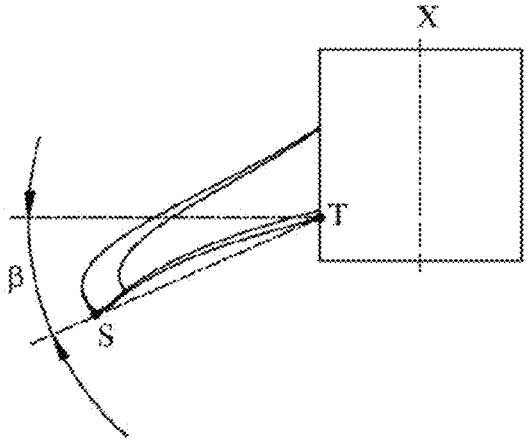
FIG. 5 is a side view of the axial-flow impeller in FIG. 1 in a second direction.

FIG. 5 is a side view of the axial-flow impeller 100 in FIG. 1 viewed in a second direction to show a specific structure of the leading edge 222. As shown in FIG. 5, a line connecting the intersection point T of the blade root 218 and the leading edge 222 and an intersection point S of the blade tip 216 and the leading edge 222 is designated as a fourth connecting line. An included angle between the fourth connecting line and the normal plane is designated as a sweep forward angle β. A value range of the sweep forward angle β is: $\beta \in [5°, 30°]$; and the leading edge 222 is located in a region formed by a rotation of the sweep forward angle β about the rotation axis X. Specifically, the region covered by the sweep forward angle β is a sector, and the region formed by the rotation of the sweep forward angle β about the rotation axis X forms an annular fan-shaped body. The leading edge 222 is located in the annular fan-shaped body. This arrangement allows for formation of a cavity in the lower surface 244, thereby controlling early separation of the shedding vortex on the upper surface 242 from the blade 112, so as to realize overall load distribution on the blade 112 and achieve a balance between the aerodynamic performance and the acoustic performance.

The inventors of the present application have found that a traditional blade is generally a twisted smooth streamlined blade, and since serious flow separation on the surface of the blade induces a vortex, it is difficult to avoid leakage from the blade tip. The blade 112 of the present application can allow for a lower load at the blade tip 216 and a larger load at the middle blade height, reduced velocity and pressure peaks of the fluid, mitigated pressure and velocity pulsations (i.e., abrupt changes), decreased number of shedding vortices, reduced intensity of shedding vortices, and delaying and suppression of vortex shedding, thus effectively improving the noise. As an example, when a traditional axial-flow impeller and the axial-flow impeller 100 of the present application operate at 900 r/min, the axial-flow impeller 100 of the present application has noise lower than the traditional axial-flow impeller by 2.5 dB.

Figure 6A:
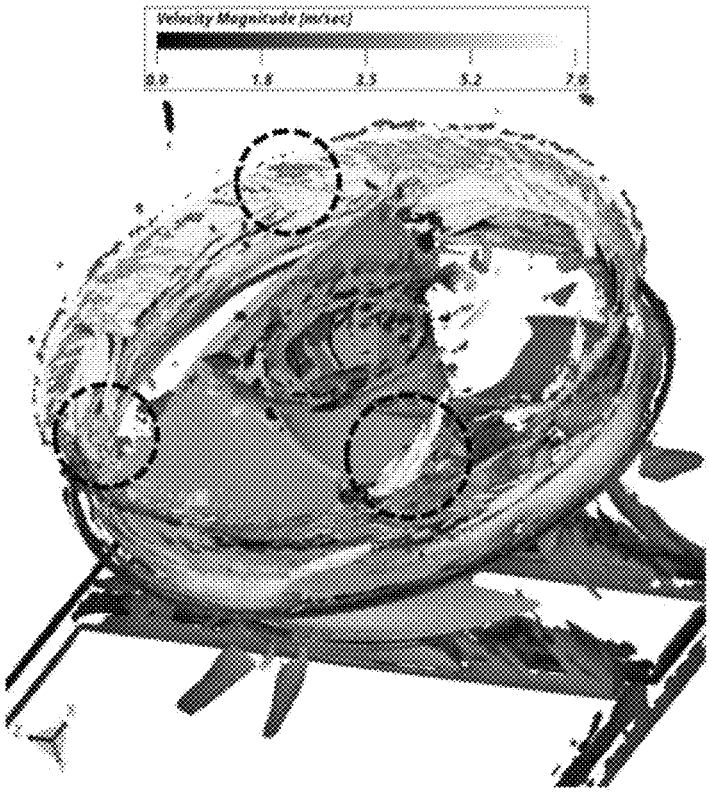
FIG. 6A is a diagram of surrounding airflow simulation of a traditional axial-flow impeller.
Figure 6B:
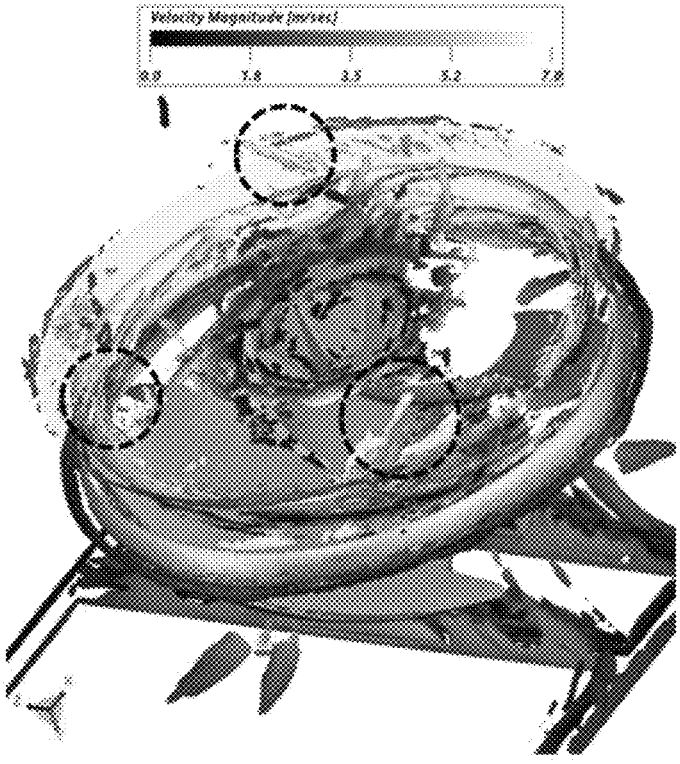
FIG. 6B is a diagram of surrounding airflow simulation of an axial-flow impeller according to the present application.

FIG. 6A is a diagram of surrounding airflow simulation of a traditional axial-flow impeller, and FIG. 6B is a diagram of surrounding airflow simulation of an axial-flow impeller 100 according to the present application. As shown in FIG. 6A, during the operation of the axial-flow impeller, turbulent vortices with high flow velocities would be produced by air in the vicinity of the junction of the leading edge and the blade tip of the blade and air in the vicinity of the junction of the trailing edge and the blade tip of the blade. However, as shown in FIG. 6B, during the operation of the axial-flow impeller of the present application, turbulent vortices in the vicinity of the junction of the leading edge and the blade tip of the blade and in the vicinity of the junction of the trailing edge and the blade tip of the blade are significantly reduced.

Figure 7A:
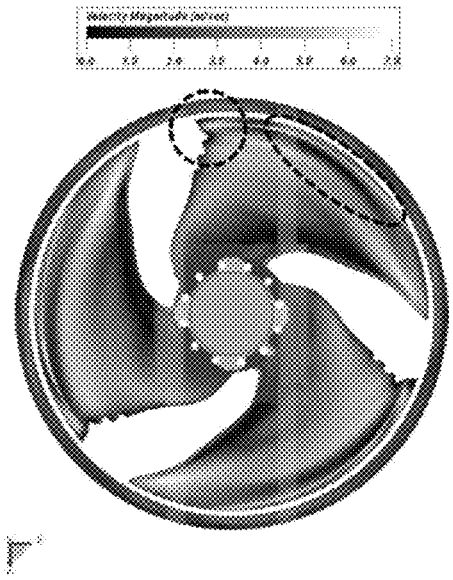
FIG. 7A is a top view of airflow simulation of a traditional axial-flow impeller.
Figure 7B:
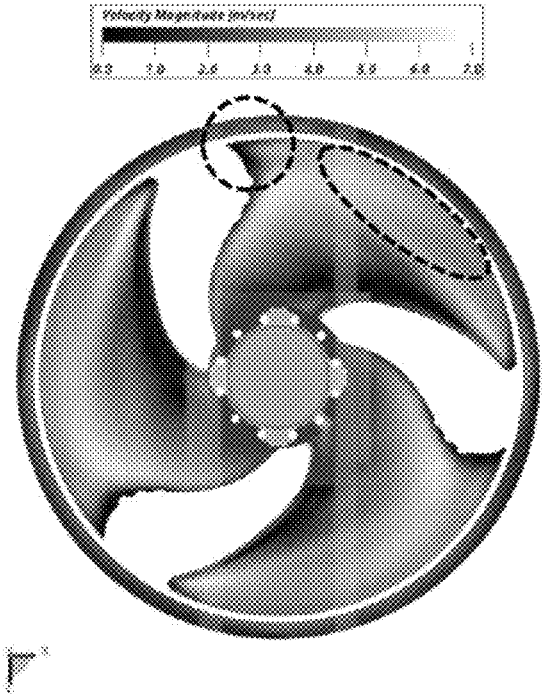
FIG. 7B is a top view of airflow simulation of an axial-flow impeller according to the present application.

FIG. 7A is a top view of airflow simulation of a traditional axial-flow impeller, and FIG. 7B is a top view of airflow simulation of an axial-flow impeller 100 according to the present application. As shown in FIG. 7A, during the operation of the axial-flow impeller, when air flows across the upper surface of the blade from the leading edge, an airflow with a lower velocity would be formed at a portion near the blade tip, thereby forming a load which is applied to a blade portion near the blade tip. However, as shown in FIG. 7B, during the operation of the axial-flow impeller of the present application, the load of the airflow on the blade is uniformly lightened such that the velocity of the airflow on the upper surface of the blade near the blade tip is not significantly reduced, resulting in more uniform velocity, mitigated velocity pulsations and reduced noise. Furthermore, the noise can also be reduced by a decrease in velocity at a position of the blade tip close to the trailing edge.

While only some features of the present application have been illustrated and described herein, various improvements and changes will occur to those skilled in the art. It is therefore to be understood that the appended claims are intended to cover all the improvements and changes that fall within the scope of the spirit of the present application.

The invention claimed is:

1. A blade, comprising:

a blade tip, a blade root, a leading edge and a trailing edge, wherein the leading edge and the trailing edge extend from the blade tip to the blade root, respectively, and the blade is configured to rotate about a rotation axis (X) that is perpendicular to a normal plane, wherein:

in a projection of the blade on the normal plane, a circumferential included angle between the leading edge and the trailing edge forms a wrap angle o, and the wrap angle ¢ decreases gradually from the blade root to a middle blade height of the blade and increases gradually from the middle blade height to the blade tip, and wherein the middle blade height is an arc line formed by center points of the blade tip and the blade root along a radial direction.

2. The blade of claim 1, wherein:

the rotation axis (X) and the normal plane intersect perpendicularly at a foot of a perpendicular (O), a line connecting any point on the leading edge and the foot of the perpendicular (O) is designated as a first connecting line, a line connecting a projection point (A) of an intersection point of the blade root and the leading edge on the normal plane in a direction of the rotation axis (X) and the foot of the perpendicular (O) is designated as a second connecting line, and an included angle between the first connecting line and the second connecting line is a starting angle ⊖, and wherein the starting angle ⊖ increases gradually in a direction from the blade root to the blade tip.

3. The blade of claim 2, wherein:

a value range of the starting angle ⊖ is: $\ominus \in [0°, 90°]$.

4. The blade of claim 1, wherein:

the blade comprises an upper surface and a lower surface, and the upper surface and the lower surface are curved downwards in a radial cross section of the blade from the middle blade height to the blade tip.

5. The blade of claim 4, wherein:

a vertical line from a highest point on the trailing edge to the rotation axis (X) is designated as a first vertical line, the first vertical line having a vertical point on the rotation axis (X), and a line connecting an intersection point of the trailing edge and the blade tip and the vertical point is designated as a third connecting line, and in a projection direction along the rotation axis (X), an included angle between the first vertical line and the third connecting line is a winglet angle α, and a value range of the winglet angle α is: $\alpha \in [1°, 15°]$.

6. The blade of claim 1, wherein:

in the projection direction along the rotation axis (X), a line connecting an intersection point of the blade root and the leading edge and an intersection point of the blade tip and the leading edge is designated as a fourth connecting line, an included angle between the fourth connecting line and the normal plane is designated as a sweep forward angle β, and a value range of the sweep forward angle β is: $\beta \in [5°, 30°]$, and the leading edge is located in a region formed by a rotation of the sweep forward angle β about the rotation axis (X).

7. An axial-flow impeller comprising:

a hub having a rotation axis (X), wherein the hub is configured to rotate about the rotation axis (X); and at least two blades according to claim 1, wherein the at least two blades are arranged on an outer circumferential surface of the hub.

8. The axial-flow impeller of claim 7, wherein:

the wrap angle ϕ is related to a number of the blades.

9. The axial-flow impeller of claim 8, wherein:

the axial-flow impeller comprises three blades, and a value range of the wrap angle ϕ is: $\phi \in [80°, 100°]$;

the axial-flow impeller comprises four blades, and the value range of the wrap angle ϕ is: $\phi \in [60°, 85°]$, or the axial-flow impeller comprises five blades, and the value range of the wrap angle ϕ is: $\phi \in [40°, 70°]$.

* * * * *